United States Patent [19]

de Vries

[11] Patent Number: 4,494,037

[45] Date of Patent: Jan. 15, 1985

[54] GAS DISCHARGE DISPLAY DEVICE HAVING ANODIZED AND UNANODIZED ELECTRODE SURFACE AREAS

[75] Inventor: Gerhard H. F. de Vries, Geldrop, Netherlands

[73] Assignee: U.S. Philips Corporation, New York, N.Y.

[21] Appl. No.: 416,182

[22] Filed: Sep. 9, 1982

Related U.S. Application Data

[63] Continuation-in-part of Ser. No. 270,679, Jun. 4, 1981, Pat. No. 4,389,277.

[51] Int. Cl.[3] ..... H01J 17/49; H01J 61/067

[52] U.S. Cl. ..... 313/584; 313/632

[58] Field of Search ..... 313/584, 632

[56] References Cited

U.S. PATENT DOCUMENTS

| | | | |
|---|---|---|---|
| 3,842,308 | 10/1974 | Esdonk et al. | 313/584 |
| 3,908,147 | 9/1975 | Hall et al. | 313/584 |
| 3,936,688 | 2/1976 | Esdonk et al. | 313/584 |

*Primary Examiner*—Palmer Demeo

*Attorney, Agent, or Firm*—Paul R. Miller

[57] ABSTRACT

An improved gas discharge display device is provided having an envelope of at least one glass plate with an electrode pattern thereon. The electrode pattern is formed into small surface elements constituting cathode areas, and is provided in facing relationship to another electrode pattern constituting anodes.

4 Claims, 7 Drawing Figures

GAS DISCHARGE DISPLAY DEVICE HAVING ANODIZED AND UNANODIZED ELECTRODE SURFACE AREAS

This application is a Continuation-In-Part application of Ser. No. 270,679, filed June 4, 1981, now U.S. Pat. No. 4,389,277, and the benefits for the parent application are hereby claimed for this application.

The invention relates to a method of manufacturing an electric discharge device having a pattern of electrodes provided on a glass substrate with the electrodes being bonded to a surface of the glass substrate by an anodic bonding process; and also to an electric discharge device manufactured by such a method.

In the manufacture of an electric discharge device, it is often necessary to provide patterns of electrodes on a glass substrate. For that purpose, according to a generally known method, a metal layer is vapour-deposited or sputtered onto the surface of the substrate and the desired pattern of electrodes is obtained by locally removing parts of the metal layer. According to this method, only thin metal layers not more than a few microns thick can be provided. For providing thicker layers having a thickness of a few tens of microns, this method is very time-consuming, and the adhesion of the metal layer to the substrate for these thick layers is insufficient for many applications. When, for example in gas discharge display devices, the electrodes must be capable of passing some current and the electric resistance of the electrodes must be low, such a method is not very suitable.

Therefore, there is a need for a method wherein patterns of comparatively thick electrodes can be provided on a glass substrate which electrodes adhere adequately to the substrate.

U.S. Pat. No. 4,083,710 discloses a method of providing a pattern of electrodes in the form of parallel strip-shaped conductors on a glass substrate. A die having a relief pattern consisting of parallel ridges is made and the strip-shaped conductors are temporarily provided on the ridges by means of an adhesive and are then transferred to the glass substrate. This transfer is effected by pressing the die with the conductors against the surface of the substrate and bonding the conductors to the surface of the substrate by means of a pressure bonding process. In this manner a pattern of electrodes corresponding to the relief of the die is formed on the substrate.

The accuracy in the mutual positioning of the conductors on the substrate depends on the accuracy with which the conductors can be provided on the die in registration with the pattern of ridges. Providing the strip-shaped conductors on the die in registration with the ridges is effected by means of a roller having grooves in which the strip-shaped conductors are guided. The distance between the grooves determines the distance between the conductors. The size accuracy of the pattern of electrodes is hence restricted by the size accuracy of the tools used. Furthermore, this method is restricted to the provision of strip-shaped patterns of electrodes.

It is an object of this invention to provide a method of manufacturing an electric discharge device having a pattern of electrodes provided on a glass substrate in which the pattern of electrodes adheres satisfactorily to the substrate, has a good size accuracy and may have any shape and desired thickness.

In particular, the present invention provides a pattern of very small cathode areas in a gas discharge device having the construction of the invention.

According to the invention, a method of the kind mentioned in the opening paragraph is characterized in that a metal foil is provided on the surface of the substrate to be provided with the pattern of electrodes, the assembly of metal foil and substrate is heated to a temperature $T_1$ which is lower than the melting-point of the metal of the foil and at which the viscosity of the glass of the substrate has a value in the range from $10^7$ to $10^{13}$ Pas., the metal foil at the temperature $T_1$ is uniformly pressed against the substrate surface for a time which is sufficient to obtain a uniform contact between the metal foil and the substrate, the metal foil is bonded to the substrate by means of an anodic bonding process, and the desired pattern of electrodes is then formed by the local removal of the metal foil.

By covering the surface of the substrate to be provided with a pattern of electrodes with a metal foil, then bonding the foil to the substrate, and finally forming the desired pattern of electrodes from the foil, a number of important advantages are obtained. The method is fast and is extremely suitable for mass production. Metal foils of any thickness desired for the field of application of the invention may be used. Any desired pattern of electrodes can be obtained from the metal foil bonded to the substrate, for example, by means of photoetching methods with the great accuracy associated with these methods.

For the successful application of the invention, however, it is necessary that a uniform surface contact should be produced between the metal foil and the substrate for at least that part of the foil from which the pattern of electrodes is to be formed afterwards. Uniform contact is to be understood to mean herein a tight surface contact without gas inclusions between the metal foil and the substrate. According to the invention, this requirement is met by laying the metal foil on the substrate surface, heating the assembly to a temperature $T_1$ which is lower then the melting-point of the metal of the foil, and at the temperature $T_1$, the viscosity of the glass of the substrate is in the range from $10^7 \times 10^{13}$ Pas., and then pressing the metal foil uniformly against the substrate surface.

In the indicated viscosity range, the glass can be deformed so that a uniform contact is produced between the foil and the substrate when a uniform pressure is exerted on the foil. The time which is necessary to produce a uniform contact between the metal foil and the glass depends on the value of the pressure, the surface state of the metal foil and the glass substrate, and the extent of deformability of the glass. According to an embodiment of the invention, a pressure is used in the range from $3 \times 10^5$ to $8 \times 10^5$ N/m$^2$ and is maintained for a period of from 5 minutes to 60 minutes. According to a preferred embodiment of the invention, upon pressing the foil and substrate against each other, first the foil is pressed against the substrate over a restricted surface area, after which the pressure is gradually expanded over a region expending towards the edges of the foil. This can be realized, for example, by means of a diaphragm which presses against the foil and of which a larger and larger area is contacted with the foil by increasing the pressure on the diaphragm.

After having produced a uniform contact between foil and the substrate, the foil is bonded to the substrate by means of anodic bonding. This method comprises applying an electrical potential difference over the parts to be bonded at a temperature $T_2$, where the surfaces to be bonded are kept in close contact with each other. The temperature $T_2$ is chosen to be so high that the part to be bonded of insulating material becomes slightly electrically conductive. During the bonding of the surfaces, these surfaces are kept in close contact with each other as a result of the electrical potential difference by electrostatic forces, which is, if desired, supplemented by mechanical pressure.

Such a bonding method is disclosed inter alia in U.S. Pat. No. 3,397,278 and U.S. Pat. No. 3,589,965. Reference is made to these patents for further details regarding this bonding method.

According to another embodiment of the invention the metal foil consists of an aluminium foil. This metal is very ductile which is favourable in order to obtain a uniform surface contact when the foil and the substrate are pressed against each other. Foils having a thickness of up to 300 $\mu$m can be provided on the surface of a glass substrate in the manner according to the invention in a satisfactorily adherent and bubble-free manner.

According to a further embodiment of the invention, an aluminium foil is used in combination with a soft-glass substrate, in particular a soda lime glass. At a temperature $T_1$ in the range from 550° to 600° C., the aluminium foil is pressed against the soft-glass substrate at a pressure of approximately $5\times10^5$ N/m$^2$ for approximately 30 minutes, which results in a uniform contact between aluminium foil and substrate. At a temperature $T_2$ in the range from 230° to 280° C., an electric voltage is then applied across the glass substrate and the aluminium foil for at least 3 minutes, which electric voltage results in a current of 0.2 to 0.7 A/m$^2$ flowing through the glass substrate, this treatment producing a strong bond between the aluminium foil and the substrate.

The invention is of particular importance for the manufacture of flat display panels, for example, gas discharge display panels having an envelope comprising at least one glass plate on which a pattern of electrodes has been provided. Such patterns of electrodes should be constructed from electodes which are accurately defined with respect to mutual position and dimensions. The use of aluminium foils has several advantages because aluminium is a metal which can easily be worked. A pattern of aluminium electrodes provided on the glass plate according to the invention can be provided with an electrically insulating oxide film either locally or entirely by means of anodic oxidation. By photographically providing an anodic oxide film locally on the electrodes, accurately defined electrode areas, such as cathode areas, not provided with insulation (oxide film) can be obtained, which is important for d.c.-operated display panels having a large resolving power.

Accordingly, the method is very suitable for the manufacture of storage display panels. Such panels normally require a resistor in series with each gas discharge cell. However the internal impedance of the gas discharge itself can be used to control the current so that in effect the current versus voltage characteristic is equivalent to that of devices in which an individual resistor is connected in series with each cell. It has been found that sufficiently high values for the positive slope dV/di, that is the internal impedance of the gas discharge itself, can be obtained when small cathode areas are provided. As such the effect has been known but the current densities implied were liable to lead to rapid erosion of the cathode. This problem however is avoided when manufacturing display panels in accordance with the present invention. Therefore, these panels, provided with small accurately defined cathode areas, not only have a large resolving power, but can also be operated as d.c. gas discharge display panels with internal memory. By providing the whole pattern of electrodes with an anodic oxide film, a display panel can be obtained which can be a.c.-operated.

The envelope of a gas discharge display panel may comprise a second glass plate which is also provided with a pattern of electrodes consisting of aluminium foil, and the patterns of electrodes on the first and second glass plates are each provided with an electrically insulating oxide film.

The invention also provides a solution to problems occurring in the vacuum-tight sealing together of the glass plates in display panels. Special measures, for example, in the form of silver lead-through strips, had often to be taken to seal the panel in a vacuum-tight manner at the area where the electrodes are led through. It has been found that such measures are not necessary in display panels manufactured according to the invention. The bonding of the electrodes to the glass substrate is vacuum-tight and the sealing glass, usually in the form of a "glass frit", also produces a vacuum-tight connection between the glass plates of the panel at the area where the electrodes are led through the panel.

In a gas discharge display panel comprising two glass plates each bearing a pattern of electrodes, one of the glass plates is bonded along a closed circuit by means of a sealing glass to the other glass plate, and the pattern of electrodes has extensions formed integrally therewith, which extensions cross the circuit of sealing glass, and at the area of such a crossing on the one hand adhere directly to the glass plate, and on the other hand adhere directly to the sealing glass, so as to form a vacuum-tight electric lead-through for an electrode of the pattern of electrodes.

Embodiments of the invention will now be described with reference to the drawings, in which.

Figure 1:
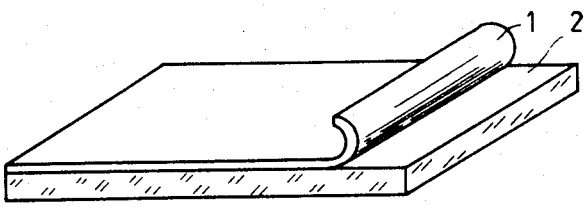
FIGS. 1, 2 and 3 illustrate three stages of an embodiment of the method according to the invention.
Figure 2:
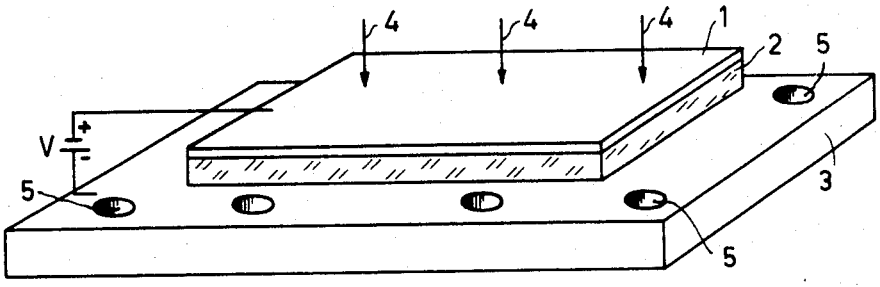

FIG. 1 illustrates the provision of an aluminium foil 1 which is approximately 100 $\mu$m thick on a glass plate 2. The glass plate 2 consists of a soda lime glass consisting essentially of 69.5 wt. % $SiO_2$, 10 wt. % $Na_2O$, 7.5 wt. % $K_2O$, 10 wt. % CaO and 3 wt. % BaO. As shown in FIG. 2, the assembly consisting of the glass plate 2 and the aluminium foil 1 are laid on a stainless steel base plate 3, and this structure is then heated in a furnace to a temperature $T_1$ in the range from 550°-600° C. At this temperature the soda lime glass has a viscosity of approximately $10^{10}$ Pas.

After the temperature $T_1$ has been reached, the aluminium foil 1 is pressed uniformly against the glass plate 2 at a pressure of approximately $5\times10^5$ N/m$^2$ for approximately 30 minutes so as to obtain a uniform surface contact between the aluminium foil 1 and the glass plate 2. During the application of this uniform pressure (indicated by the arrow 4), the formation of local gas inclusions between the aluminium foil 1 and the glass plate 2 should be avoided. For that purpose, the aluminium foil 1 is first pressed against the glass plate 2 over a restricted control area, and then the area over which pressure is applied is extended over an area progressing towards the edges of the foil.

Figure 3:
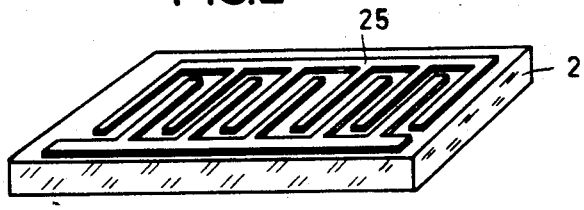

As is shown diagrammatically in FIG. 2 by means of a voltage element V, the glass plate 2 and the aluminium foil 1 are bonded together by means of anodic bonding. This bonding process takes place at a temperature $T_2$ of approximately 250° C. and consists in applying an electric potential difference across the glass plate 2 and the foil 1 which results in an electric current of approximately 0.5 $A/m^2$ passing through the glass plate 2 for at least 3 minutes. By means of known photographic methods, any desired pattern of electrodes can now be etched from the bonded aluminium foil with the great accuracy associated with this technique. In this manner a glass plate provided with a satisfactorily adherent pattern of electrodes of the desired thickness is obtained. FIG. 3 shows such a plate 2 bearing a pattern of electrodes 25 obtained by a photographic etching process.

Figure 4:
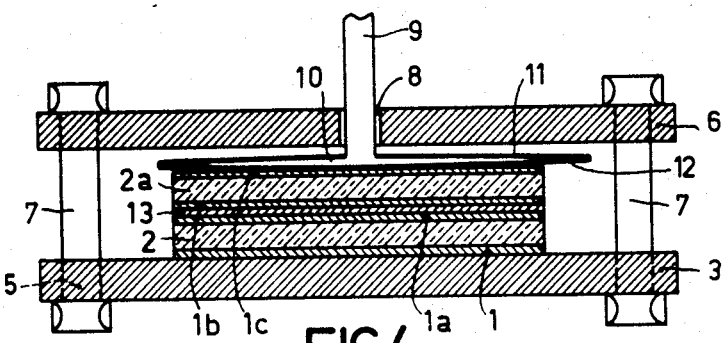
FIG. 4 shows diagrammatically a device for producing a uniform surface contact between a metal foil and a flat glass substrate.

The device shown in FIG. 4 shows that it is possible to simultaneously bond metal foils 1 to a number of glass plates 2, for instance two glass plates 2 and 2*a*. A steel top plate 6 is kept at a predetermined distance from the base plate 3 by means of a number of bolts 7 which engage in threaded bores 5 in the base plate 3. The top plate 6 comprises a central aperture 8 through which a tube 9 extends. The tube 9 is connected at one end to a pin-cushion-like steel expansion vessel 10 consisting of two metal diaphragms 11 and 12 which are sealed together at the edges in a vacuum-tight manner. The glass plate 2 is placed between two metal foils 1 and 1*a*. The glass plate 2*a* is placed between two metal foils 1*b* and 1*c*.

The plates 2 and 2*a* are stacked one on top of the other and a chromium-nickel-iron plate 13 is placed between the abutting metal foils 1*a* and 1*b*. This chromium-nickel-iron plate 13 is covered on each major surface with a layer of graphite or boron nitride so as to prevent the abutting foils 1*a* and 1*b* from adhering together. This structure is disposed between the base plate 3 and the diaphragm 12 of the expansion vessel 10 and subsequently heated to a temperature in the range from 550°–600° C. By the tube 9 the pressure in the expansion vessel 10 is then increased to approximately $4\times10^5$ $N/m^2$ and this pressure is maintained for about 30 minutes.

When pressurizing the expansion vessel 10, the contact surface between the diaphragm 12 of the expansion vessel 10 and the foil 1*c* on the top glass plate 2*a* will gradually be expanded from the center towards the edges of the foil 1*c*. In this manner the formation of gas inclusions (gas bubbles) between the glass plate 2 and the foils 1 and 1*a* as well as between the glass plate 2*a* and the foils 1*b* and 1*c* is avoided. By means of a similar bonding process as described with reference to FIG. 2 the metal foils 1*a* and 1*c* or 1 and 1*b* are simultaneously bonded to the glass plates 2 and 2*a* by applying an electric potential difference across the stacked structure. Dependent on the polarity of the electric voltage the foils 1*a* and 1*c* or 1 and 1*b* will adhere to the respective glass plates 2 and 2*a*. The non-adhered metal foils can easily pulled off the glass plates.

Figure 5:
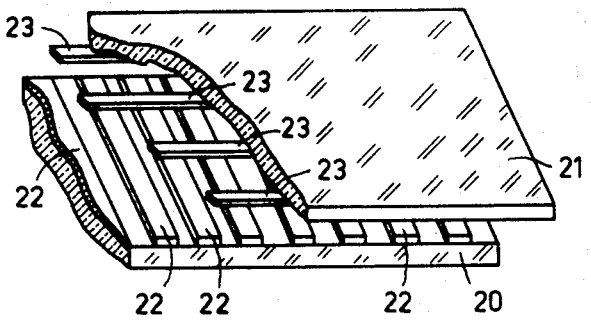
FIG. 5 shows part of an elementary form of a gas discharge display panel provided with a pattern of electrodes manufactured by a method according to the invention.

The method according to the invention is very suitable for use in the manufacture of gas discharge display devices. FIG. 5 shows the most elementary form of such a display device. The device in this Figure consists of a glass base plate 20 and a glass top plate 21. According to the method described with reference to FIGS. 1 to 4, a pattern of electrodes in the form of aluminium strip-shaped electrodes 22 is provided on the base plate 20. The electrodes 22 form the cathodes of the display device. The top plate 21 is provided with a pattern of electrodes 23 in an analogous manner consisting of strip-shaped electrodes 23 which cross the electrodes 22 and constitute the anodes of the display device.

The glass plates 20 and 21 are kept at a defined distance from each other by means of spacing members not shown and are sealed together at the edges in a vacuum-tight manner by means of a sealing glass. The space between the plates 20 and 21 is filled with a suitable ionizable gas, for example neon or a mixture of neon and argon. By applying a suitable voltage difference between a cathode 22 and an anode 23, a glow discharge which is visible through the top plate 21 is generated at the area where the anode and cathode cross each other. By scanning the anodes 23 and the cathodes 22 with a sufficiently high frequency in a predetermined sequence with voltage pulses corresponding to the picture information, a picture built up from discharge points can be displayed which is observed as an apparently continuous light picture. This briefly described display panel is d.c.-operated. When the electrodes 22 and 23 consist of aluminium, the panel can be made suitable for a.c.-operation in a simple manner by providing the aluminium electrodes 22 and 23 with an electrically insulating oxide film by means of anodic oxidation.

It is also possible to provide the cathode 22 with an anodic oxide film with the exception of small regions at the area where the cathodes cross an anode. In this manner accurately defined discharge regions are obtained and a discharge panel having a large resolving power can be manufactured.

Figure 6:
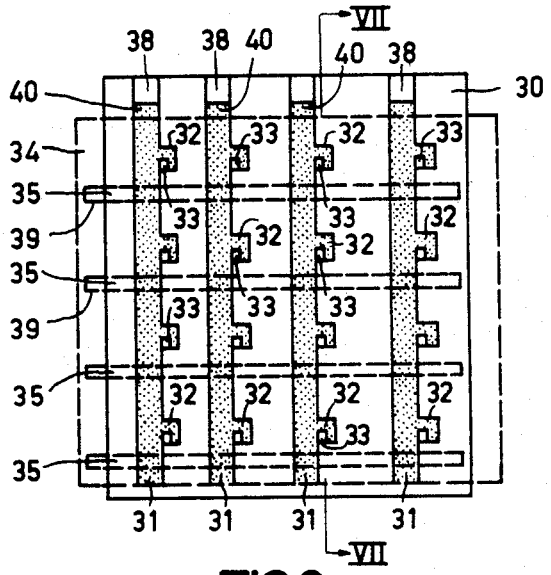
FIG. 6 is a plan view of another embodiment of a gas discharge display panel manufactured by a method according to the invention.
Figure 7:
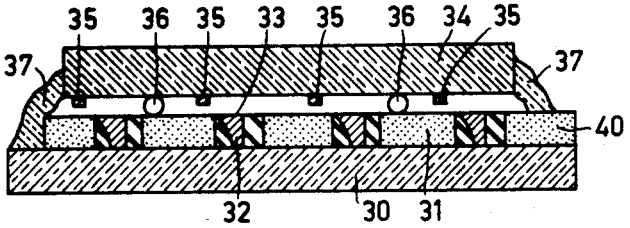
FIG. 7 is a sectional view taken on the line VII—VII of the gas discharge display panel shown in FIG. 6.

FIGS. 6 and 7 show a particular embodiment of a gas discharge display panel having a pattern of electrodes obtained according to the invention. In the manner according to the invention, a pattern of aluminium electrodes, approximately 50 μm thick, consisting of parallel cathode strips 31 having transverse projections 32 is provided on a glass base plate 30. The cathodes 31 are provided with an approximately 20 μm thick oxide skin by anodic oxidation (shown in FIG. 6 by dotted areas), with the exception of small surface elements 33 present on the transverse projections 32. The surface elements 33, not provided with an anodic oxide film, form the surface parts of the cathodes 31 which are active for a discharge.

These surface elements 33 can be obtained by selective photoetching. For that purpose, a layer of photoresist is provided on the aluminium electrode pattern and is exposed by a photomask in such manner that after development only the surface elements 33 to be formed are covered with a layer of photoresist. The pattern of electrodes is then subjected to an anodic oxidation process, in which, the photoresist-covered surfaces excepted, an oxide film which is approximately 20 μm is obtained. The surface elements 33 are then exposed by removing the resist layer. In order to obtain a discharge, the surface elements 33 co-operate with strip-shaped anodes 35 provided on a top plate 34 (shown in broken lines in FIG. 6). In this manner a gas discharge panel having very accurately defined active surface elements situated closely together is obtained. Moreover, each discharge is restricted to a very small cathode area so that a picture having a very large resolving power is obtained.

When the cathode area is small the panel may simply be operated as a storage display panel. Taking into account that the power dissipation of the panel may not exceed about 300 $W/m^2$ and assuming that in operating the panel about one third of the number of gas discharge cells is energized the maximum value of the cathode area follows from the condition:

$$\frac{1}{3} \cdot \frac{j \cdot A_c \cdot V}{A_d} \leqq 300$$

where j represents the current density in a display cell, $A_c$ the cathode area, V the cell voltage, and $A_d$ the display area of the cell. Generally this condition is satisifed when the cathode area is smaller than about 500 $\mu m^2$.

FIG. 7 is a sectional view taken on the line VII—VII in FIG. 6, The base and top plates 30 and 34, respectively, are kept at a defined distance from each other by means of spacing elements 36 and are sealed together in a vacuum-tight manner at the edges by means of a sealing glass 37. The cathodes 31 can be provided with the desired electric voltages at surface parts 38 situated outside the panel and which are not covered by anodically formed oxide.

As shown in FIGS. 6 and 7, the electrodes 35 and 31 comprise integrally formed extensions 39 and 40, respectively, and the desired electric voltages to the electrodes externally are applied to the electrodes through the respective extension. The invention provides a vacuum-tight seal of the extensions 39 and 40 to the glass plates 34 and 30, respectively. Due to this vacuum-tight seal, a vacuum-tight seal of the discharge panel is also obtained at the area of the extensions by means of the sealing glass 37. It is furthermore to be noted that in the embodiment shown in FIGS. 6 and 7, the discharges between an anode 35 and a cathode surface element 33 occur substantially parallel to the panel. Due to the insulating anodic oxide film, the anodes 35 may then rest on the cathodes 31, so that the spacing elements 36 are not essential.

What is claimed is:

1. A gas discharge display device comprising an envelope of a first and second glass plate having a gas discharge space therebetween, a first pattern of aluminum electrodes on said first glass plate in facing relationship to a second pattern of electrodes on said second glass plate, a gas filled area between said first and second pattern of electrodes, and a plurality of small surface elements constituting cathode areas formed on surface portions of said first pattern of aluminum electrodes which are anodized except for said cathode areas.

2. A gas discharge display device according to claim 1, wherein the maximum value of each of said cathode areas is determined from the relationship $$\frac{1}{3} \cdot \frac{j \cdot A_c \cdot V}{A_d} \leqq 300,$$

where j represents the current density in said display device, $A_c$ is the cathode area, V is the voltage of a discharge cell, and $A_d$ is the display area of said cell.

3. A gas discharge display device according to claim 1, wherein said cathode areas are each smaller than about 500 $\mu m^2$.

4. A gas discharge display device according to claim 1, wherein said cathode areas are provided in a matrix-like arrangement.

* * * * *